US007156612B2

(12) United States Patent
Warikoo et al.

(10) Patent No.: US 7,156,612 B2
(45) Date of Patent: Jan. 2, 2007

(54) SPIGOT ARRANGEMENT FOR A SPLIT IMPELLER

(75) Inventors: Raman Warikoo, Oakville (CA); Peter Stanculet, Toronto (CA); Farid Abrari, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 11/098,414

(22) Filed: Apr. 5, 2005

(65) Prior Publication Data

US 2006/0222499 A1 Oct. 5, 2006

(51) Int. Cl.
*F01D 1/24* (2006.01)

(52) U.S. Cl. ..... 415/69; 415/143; 416/132 R

(58) Field of Classification Search ..... 415/69, 415/143; 416/132 R, 183, 500
See application file for complete search history.

(56) References Cited

U.S. PATENT DOCUMENTS

| | | | | |
|---|---|---|---|---|
| 2,619,317 | A | | 11/1952 | Traupel |
| 2,660,399 | A | | 11/1953 | Robinson et al. |
| 2,859,933 | A | | 11/1958 | Whitaker |
| 2,941,780 | A | * | 6/1960 | Von Der Nuell et al. ... 416/182 |
| 3,065,954 | A | | 11/1962 | Whitaker |
| RE27,038 | E | * | 1/1971 | Newland ..... 416/242 |
| 3,642,383 | A | | 2/1972 | Andvig |
| 3,671,140 | A | | 6/1972 | Shank |
| 3,677,663 | A | | 7/1972 | Cronstedt |
| 3,893,817 | A | * | 7/1975 | Hackbarth et al. ..... 29/889.4 |
| 3,958,905 | A | | 5/1976 | Wood |
| 4,039,268 | A | | 8/1977 | Cotton |
| 4,053,261 | A | * | 10/1977 | Pennig ..... 416/244 A |
| 4,125,344 | A | | 11/1978 | Teifenbacher |
| 4,183,719 | A | * | 1/1980 | Bozung ..... 416/183 |
| 4,191,509 | A | | 3/1980 | Leonardi |
| 4,653,976 | A | | 3/1987 | Blair et al. |
| 4,692,976 | A | | 9/1987 | Andrews |
| 4,824,328 | A | | 4/1989 | Pisz et al. |
| 5,110,262 | A | | 5/1992 | Evans |
| 5,141,401 | A | | 8/1992 | Juenger et al. |
| 6,033,185 | A | | 3/2000 | Lammas et al. |
| 6,106,188 | A | | 8/2000 | Krautzig |
| 6,499,953 | B1 | * | 12/2002 | Bellerose et al. ..... 416/175 |
| 2004/0009060 | A1 | | 1/2004 | Romani et al. |

OTHER PUBLICATIONS

Douglas A. Roberts and Suresh C. Kacker, Numerical Investigation of Tandem-Impeller Designs for a Gas Turbine Compressor, 2001-GT-0324, Proceedings of ASME Turbo Expo 2001, Jun. 4-7, 2001, New Orleans, Louisiana, USA.

* cited by examiner

*Primary Examiner*—Hoang Nguyen
(74) *Attorney, Agent, or Firm*—Ogilvy Renault LLP

(57) ABSTRACT

A spigot arrangement for split impeller (inducer and exducer) includes a recess of the exducer and means for reducing exducer blade root stresses and localized contact stresses between inducer and exducer.

15 Claims, 4 Drawing Sheets

SPIGOT ARRANGEMENT FOR A SPLIT IMPELLER

TECHNICAL FIELD

The invention relates generally to compressors and, more particularly, to a split impeller for a gas turbine engine.

BACKGROUND OF THE ART

Split impellers, having an axial-flow rotor portion known as an inducer followed by a centrifugal rotor portion known as an exducer, typically have disc bodies attached together by a spigot arrangement to provide a frictional attachment. The intimate contact between discs results in high contact stresses between discs. Also, lack of axial spacing between discs means that inducer and exducer blade fillets are truncated, resulting in localized blade roots stresses. In some applications exducers may also have the blade leading edges extending axially upstream from the disc (i.e. the leading edge is overhung relative to the disc. All of these factors are detrimental to the stresses in the spigot configuration and particularly in the exducer leading edge region. Localized contact patterns on the contact surfaces of the spigot configuration result from local distortion of the disc bodies during engine transients (especially quick accelerations), which produces spigot load peaks, and results in high compressive stress both in the exducer blade leading edge root and at the contact points.

Accordingly, there is a need to provide an improved spigot arrangement for a split impeller for gas turbine engines.

SUMMARY OF THE INVENTION

It is therefore one object of this invention to provide a spigot arrangement for a split impeller of a gas turbine engine.

In accordance with one aspect of the present invention, there is a split impeller assembly provided for a gas turbine engine which has first and second rotor portions matingly mounted to one another at respective rear and front faces. The split impeller assembly further comprises a recess co-axially defined in the front face of the second rotor portion and has an inwardly extending radial surface spaced apart from the front face. An annular spigot protrudes axially from the rear face of the first rotor portion, and is received in the recess. The spigot has a terminal radial surface spaced apart from the rear face, the terminal radial surface contacting the inwardly extending radial surface of the recess.

In accordance with another aspect of the present invention, there is an impeller of a gas turbine engine which comprises an axial-flow rotor portion and a centrifugal rotor portion. The axial-flow rotor portion has a first array of blades extending outwardly from a first disc body thereof. The first disc body includes an annular spigot protruding axially from a rear end thereof and is coaxial with the axial-flow rotor portion. The centrifugal rotor portion has a second array of blades extending outwardly from a second disc body thereof. The second disc body includes a recess defined in an upstream side of the second disc body for snugly accommodating the annular spigot of the first disc body. The second disc body includes means for reducing localized contact stresses between the first and second disc bodies when local distortion of the disc bodies occurs during engine operation.

In accordance with a further aspect of the present invention, there is a split impeller assembly provided for a gas turbine engine, which comprises a first rotor body and a second rotor body. The first rotor body has a downstream disc face and a first axial contact face spaced axially downstream from said downstream face. The first axial contact face is disposed radially inside a peripheral portion of said downstream disc face. The second rotor body has an upstream disc face and a second axial contact face spaced axially downstream from said upstream face, the second axial contact face is disposed radially inside a peripheral portion of said upstream disc face. When said rotor bodies are mounted together said first and second faces contact one another and said peripheral portions of said downstream and upstream disc faces are spaced apart from one another.

Further details of these and other aspects of the present invention will be apparent from the detailed description and figures included below.

DESCRIPTION OF THE DRAWINGS

Reference is now made to the accompanying drawings depicting aspects of the present invention, in which.

DETAILED DESCRIPTION OF THE PREFERRED EMBODIMENTS

Figure 1:
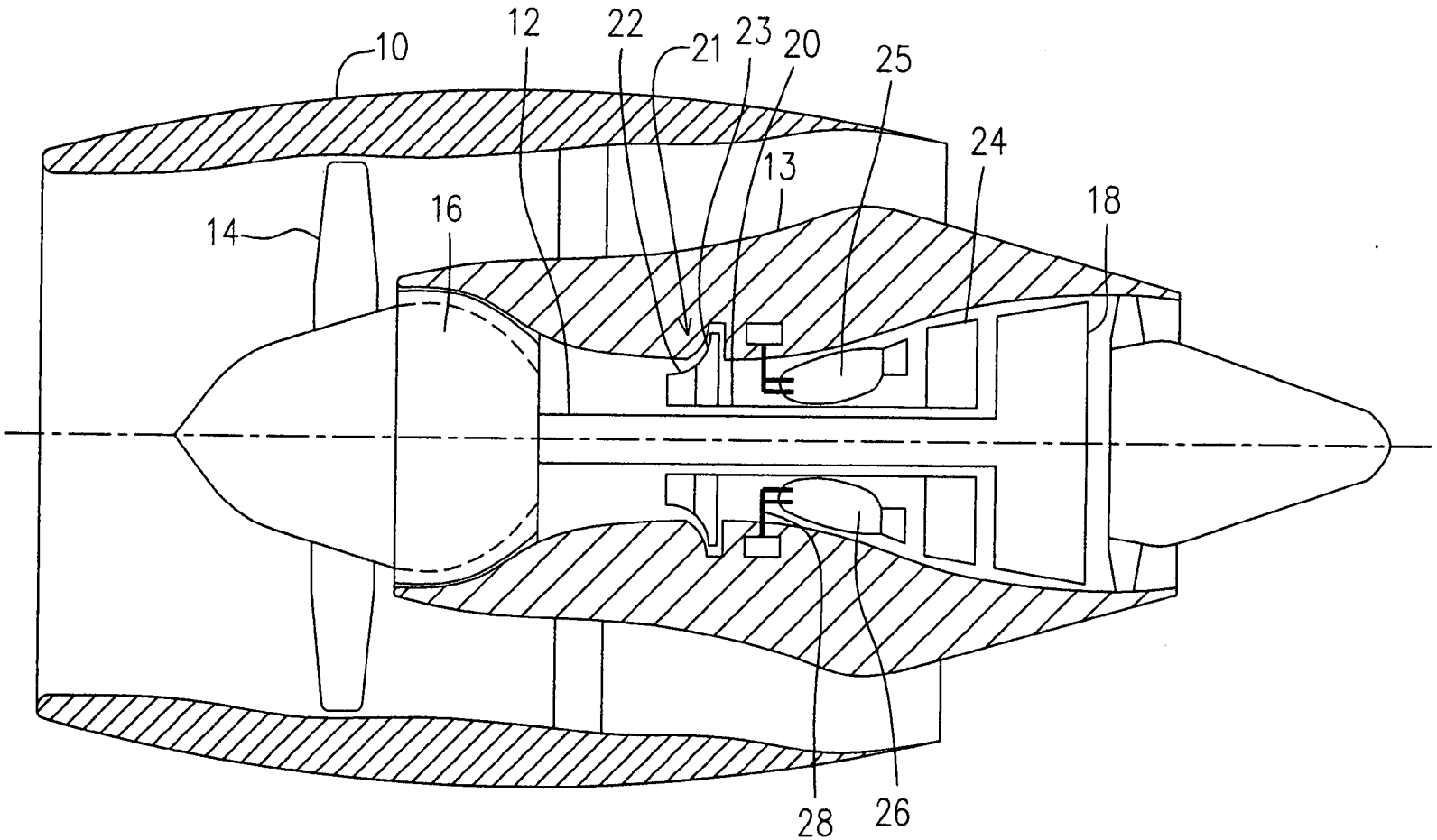
FIG. 1 is a schematic cross-sectional view of a turbofan gas turbine engine which illustrates an exemplary application of the present invention.

Referring to FIG. 1, a turbofan gas turbine engine incorporates an embodiment of the present invention, presented as an example of the application of the present invention, and includes a nacelle 10, a core casing 13, a low pressure spool assembly seen generally at 12 which includes a fan 14, low pressure compressor 16 and low pressure turbine 18, and a high pressure spool assembly seen generally at 20 which includes a split impeller 21 having an axial-flow rotor portion referred to as an inducer 22 followed by a centrifugal rotor portion referred to as an exducer 23, and a high pressure turbine 24. A combustor 26 has a plurality of fuel injectors 28. Each of the low and high pressure spool assemblies 12 and 20 includes a shaft (not indicated) rotatably and coaxially supported within the engine.

Figure 2:
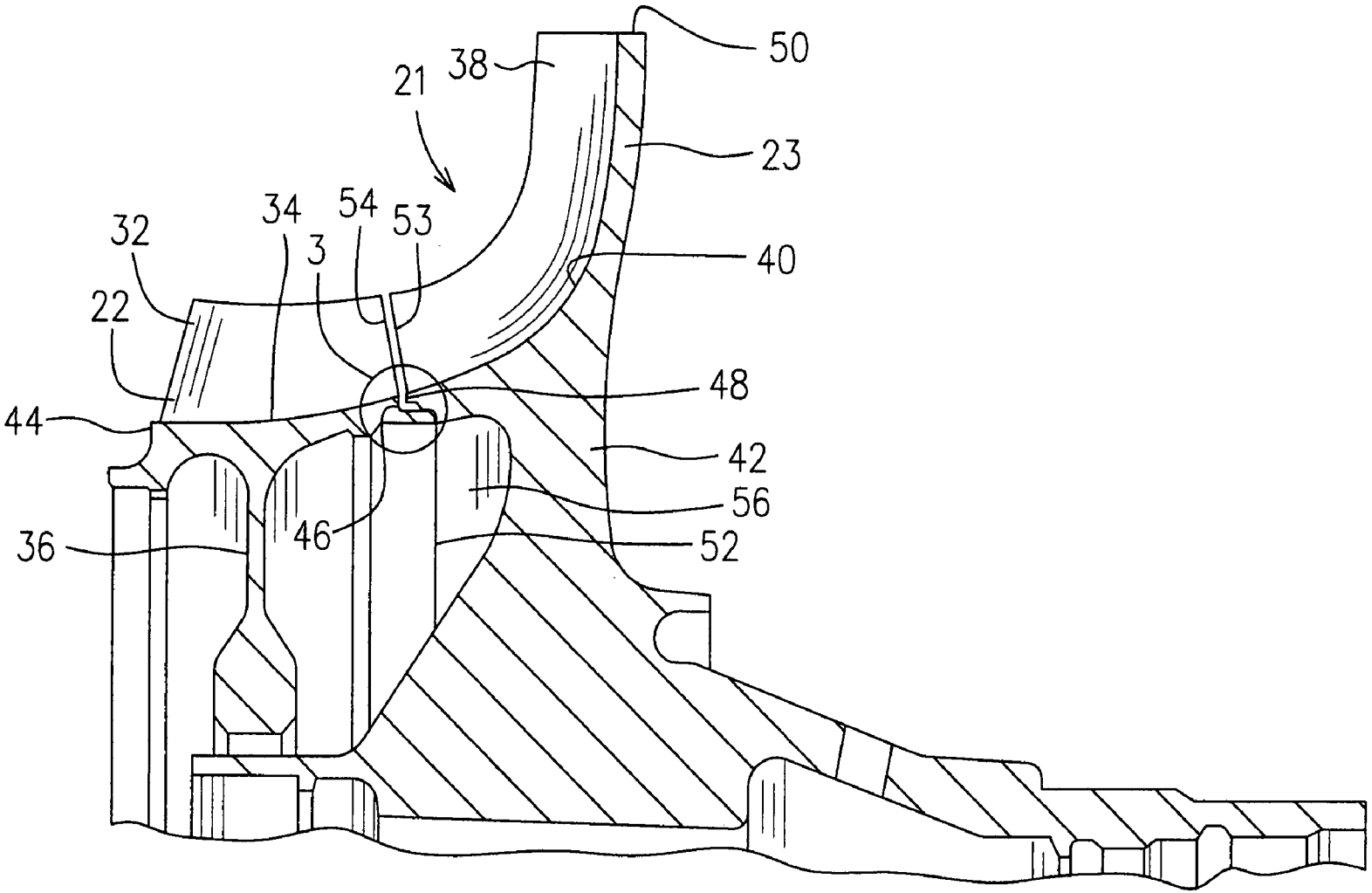
FIG. 2 is a partial cross-sectional view of the gas turbine engine of FIG. 1, illustrating a spigot arrangement for a split impeller in accordance with a preferred embodiment of the present invention.
Figure 3:
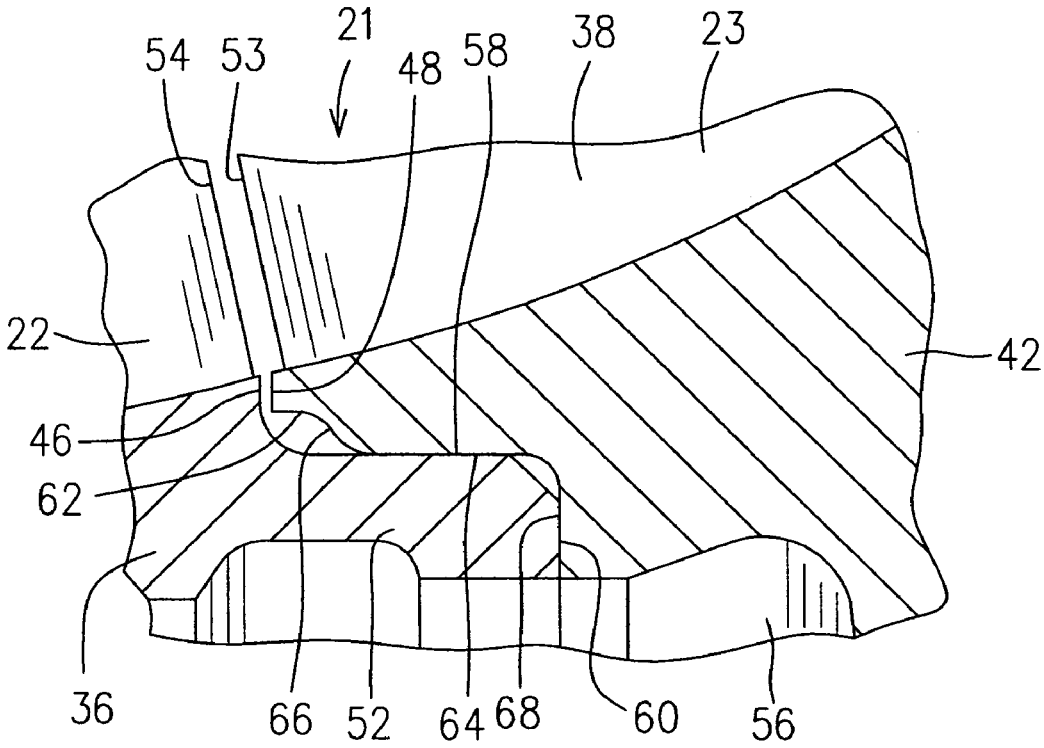
FIG. 3 is a partial cross-sectional view of the impeller of FIG. 2, as illustrated in the circled area indicated by numeral 3, in an enlarged scale showing the details of the spigot arrangement thereof.

FIGS. 2 and 3 depict the split impeller 21 of the high pressure spool assembly 20 (of FIG. 1) in accordance with one preferred embodiment of the present invention. The inducer 22 of the split impeller 21 includes a first array of circumferentially spaced apart blades 32 (only one shown) extending outwardly from blade roots (not indicated) mounted to an outer periphery 34 of a inducer disc body 36. The exducer 23 of the split impeller 21 includes a second array of circumferentially spaced apart blades 38 (only one shown) extending outwardly from exducer blade roots (not indicated) mounted to an outer periphery 40 of a exducer disc body 42.

The exducer disc body 42 of the exducer 23 is mounted to the shaft of the high pressure spool assembly 20 of FIG. 1 to be driven in rotation by the high pressure turbine 24 during engine operation. The inducer disc body 36 of the inducer 22 is attached to the exducer disc body 42 of the exducer 23 to rotate together therewith such that there is no relative rotation between the inducer 22 and the exducer 23.

The outer periphery 34 of the inducer disc body 36 (the portion from which the blades extend) extends axially from a front end 44 to a rear end 46, with a slightly and gradual radial expansion at the rear portion. The outer periphery 40 of the exducer disc body 42 extends from the front end 48 in a substantially axial direction and changes smoothly but dramatically in a radial direction towards a downstream end 50. The blades 32 and 38 have tips (not.indicated) profiled in accordance with the profile of the outer peripheries 34, 40 of the inducer and exducer disc bodies 36 and 42 such that the split impeller 21 is enabled to intake the axial flow, and then to compress and to discharge the airflow in a radial direction.

The blades 38 of the exducer 23 preferably substantially align with the blades 32 of the inducer 22, respectively. Each pair of blades 32 and 38 is spaced apart but in close proximity for aerodynamic benefits. For example, the leading edge 53 of the blade 38 is slightly, axially and circumferentially spaced apart from the trailing edge 54 of the blade 32. Also, the leading edge 53 of the exducer blade 38 extends axially upstream from exducer disc body 42 (i.e. the leading edge overhangs the exducer disc body).

Attachment of the inducer 22 to the exducer 23 is achieved by a spigot arrangement. In particular, an annular spigot 52 protrudes axially downstream from the rear end 46 of the inducer disc body 36 and is preferably coaxial with the inducer 22. The annular spigot 52 is snugly inserted into a recess 56 preferably co-axially defined in an upstream side (not indicated) of the exducer disc body 42.

The annular spigot 52 includes an outer axial surface 58, coaxial with the inducer 22, and a first radial surface 60 at a downstream end of the outer axial surface 58. The first radial surface 60 is preferably bevelled at an outer peripheral edge (not indicated). Recess 56 has a transitional surface 62 extending rearwardly from the front end 48 of the exducer disc body 42, and an inner axial surface 64 downstream of the transitional surface 62. The transitional surface 62 has a diameter substantially greater than a diameter of the annular spigot 52, such that a radial gap or space adjacent to the front end 48 is provided between spigot 52 and exducer body 42. Thus, a contact area (not indicated) of the outer and inner axial surfaces 58 and 64, is spaced axially downstream from the front end 48 of the exducer disc body 42. The transitional surface 62 preferably blends smoothly into axial surface 64 via a rounded upstream edge 66. The annular recess 56 further includes a second radial surface 68 at a downstream end of the inner axial surface 64.

The annular spigot 52 and the recess 56 are preferably sized such that the outer axial surface 58 of the annular spigot 52 is in snug contact with the inner axial surface 64 of the recess 56 to provide a frictional fit in order to facilitate inducer 22 and exducer 23 rotation together. The second radial surface 68 of the recess 56 abuts the first radial surface 60 of the annular spigot 52, thereby preventing further insertion of the annular spigot 52 into the recess 56, and resulting in a spacing or gap (not indicated) between the rear end 46 of the inducer disc body 36 and the front end 48 of the exducer disc body 42. The provision of this gap thus relocates the axial contact between the inducer and exducer disc bodies away from the exducer blade leading edge, as will be discussed further below. The size of this spacing or gap, as well as the sizings of the radial depth and axial length of transitional surface 62, will be also discussed further below.

Figure 4:
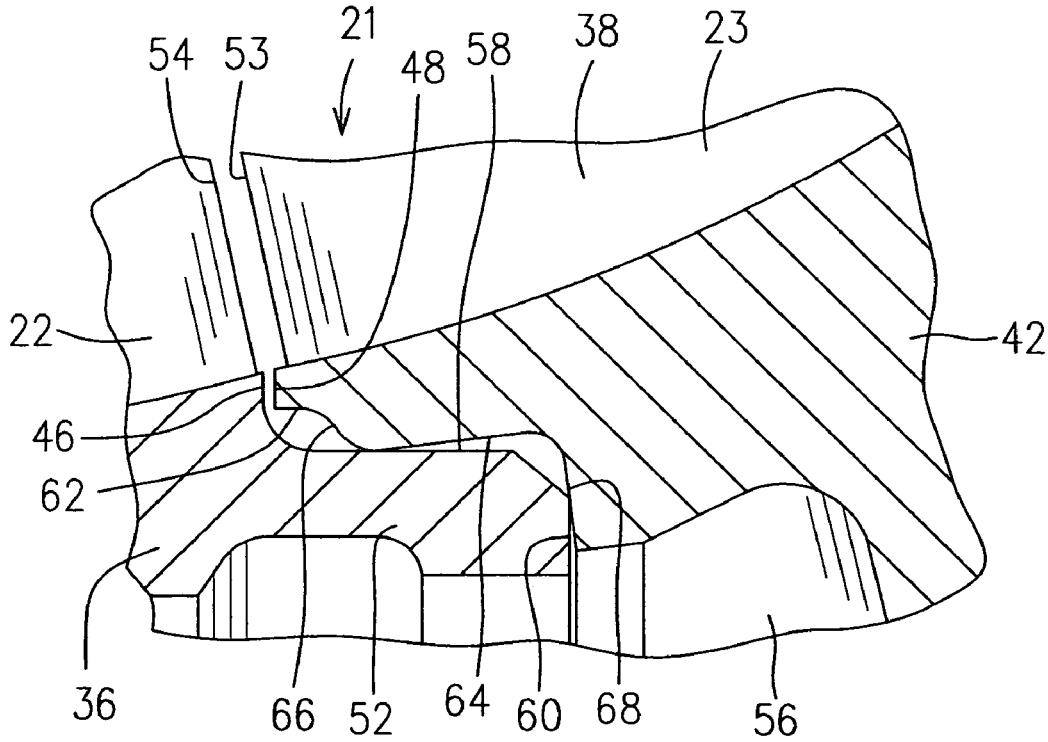
FIG. 4 is a view similar to FIG. 3, illustrating the spigot arrangement in an exaggerated manner as it is distorted during engine operation.

Referring to FIGS. 3 and 4, the spigot arrangement of the split impeller 21 according to the preferred embodiment of the present invention, is further discussed in comparison of an engine operating condition (as shown in FIG. 4) with a non-operating condition (as shown in FIG. 3). During transient engine operating conditions such as abrupt accelerations, spigot loads typically peak as the dynamic loads on the blades 38 of the exducer 23 cause local distortion of the exducer disc body 42, particularly in a blade root area close to the leading edge 53 of the blades 38. Under the influence of such distortion, the blade root and compressive contact stresses become localized in an upstream portion of the inner and outer axial surfaces 64 and 58, particularly in the location of the rounded upstream edge 66 of the inner axial surface 64. FIG. 4 illustrates in an exaggerated manner, the local distortion of the exducer disc body 42, in which the root portion of the blades 38 close to the leading edge 53 of the blades 38 has a tendency to pivot counter-clockwise (relative to the view shown) such that the downstream portion of the inner axial surface 64 together with the second radial surface 68 tends to rotate around outer axial surface 58 and the first radial surface 60, while the front end 48 of the exducer disc body 42 tends to move towards the rear end 46 of the inducer disc body 36. Contact between surfaces 60 and 68 is maintained, however, and although localised stresses increase, the robustness of the relative disc bodies at this location (relative to the inducer trailing edge-exducer leading edge location) helps in keeping the stresses to a manageable level. The space or gap between surfaces 46 and 48 is preferably sized such that transient distortion does not result in significant contact, and more preferably no contact, between these surfaces. Also, the skilled reader will appreciate that the selection of radius for rounded edge 66 is such that undue point stresses are minimized and held within an acceptable range for the materials selected. The advantages of the spigot arrangement of this preferred embodiment of the present invention will be further discussed with reference to the spigot arrangement depicted in FIGS. 5 and 6.

Figure 5:
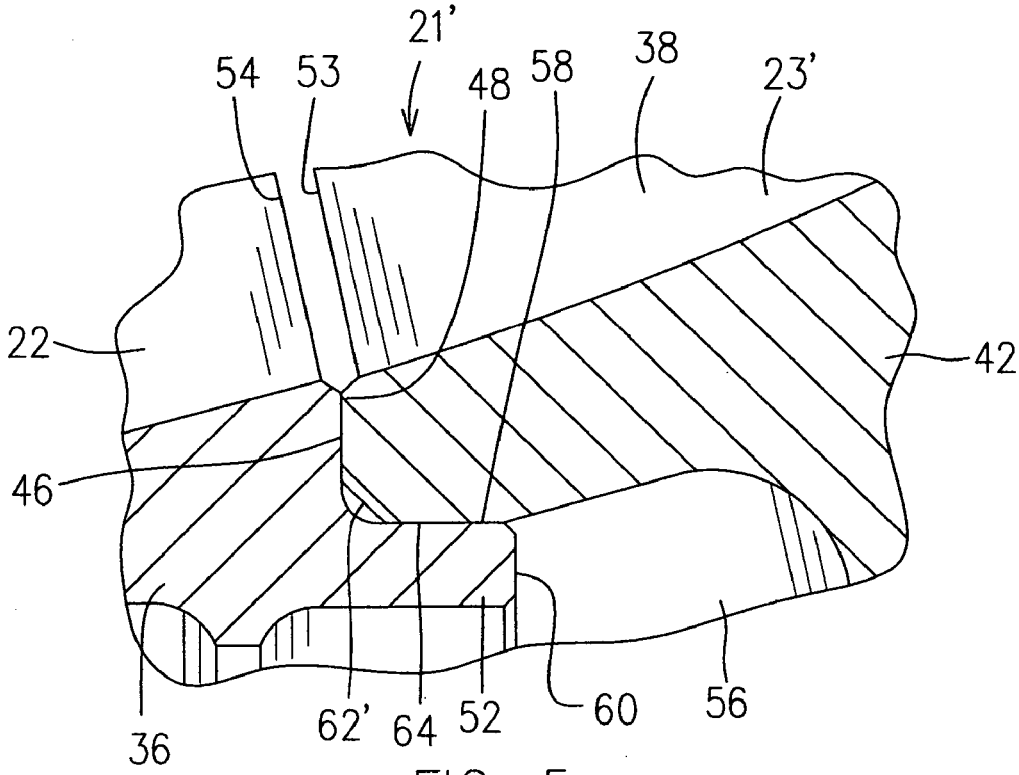
FIGS. 5 and 6 are views similar to FIGS. 3 and 4, but show an embodiment which does not employ the present invention.

FIG. 5 depicts a split impeller embodiment which does not employ the present invention, and which is presented now for comparison purposes. Similar components and features are indicated by numerals similar to those in FIG. 3 and need not be redundantly described. Split impeller 21' according to this embodiment, includes an inducer 22 substantially similar to the inducer 22 of the split impeller 21 in FIGS. 2–4, and an exducer 23' similar to the exducer 23 of split impeller 21 of FIGS. 2–4, with two major differences in the spigot arrangement. In contrast to the second radial surface 68 defined in the annular recess 56 of the exducer disc body 42 of the split impeller 21 in FIGS. 2–4, the annular recess 56 of the exducer disc body 42 of the split impeller 21' does not include such a second radial surface to abut the first radial surface 60 of the annular spigot 52. Thus, the insertion of the annular spigot 52 into the recess 56 is stopped only when the rear end 46 of the inducer disc body 36 reaches and abuts the front end 48 of the exducer disc body 42. Furthermore, a bevelled upstream edge 62' of the inner axial surface 64 of the exducer 23' replaces the transitional surface 62 which forms the rounded upstream edge 66 of the inner axial surface 64 of the recess 56 of the exducer 23 in FIGS. 2–4.

The split impeller 21' of FIG. 5 has less desirable contact conditions of the spigot arrangement between the inducer 22 and the exducer 23' of the split impeller 21', which can be illustrated with reference to FIG. 6.

Figure 6:
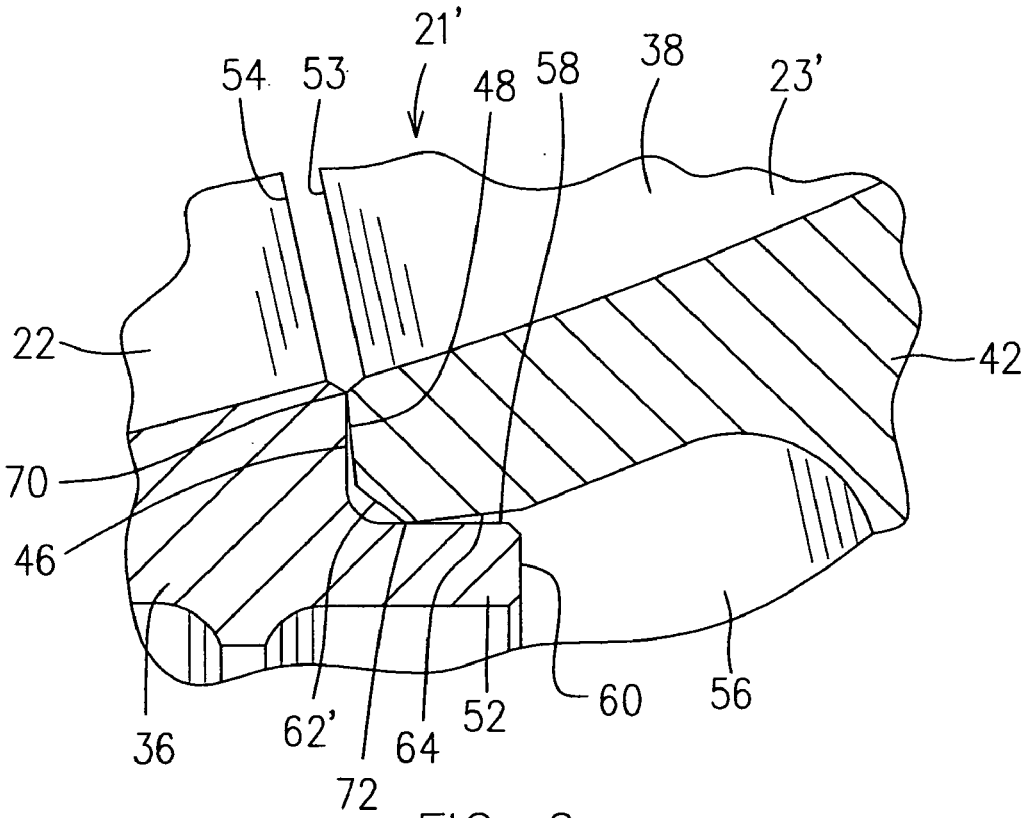

During a similar transient engine conditions similar to that of FIG. 4, as shown in FIG. 6 (in an exaggerated manner) the distortion forces resulting from the dynamic load on the blades 38 on the exducer 23', cause the rotor portion of the blades 38 close to the leading edge 53, which includes the front end 48, the inner axial surface 64 with the upstream bevelled edge 62', to have a tendency to pivot in the counter-clockwise direction and thereby localize the compressive and contact stresses in the spigot arrangement to two particular stress bearing points 70 and 72 in the cross-sectional view of the split impeller 21'. The stress bearing point 70 is located at an outer edge of the front end 48 of the exducer disc body 42, where surface 46 is contacted, and the stress bearing point 72 is located at the junction of the inner axial surface 64 and the bevelled upstream edge 62'. The skilled reader will appreciate that contact point 70 results in extremely high local stresses, and corresponds to the exducer leading edge blade root area—i.e. and area of already high stress.

In contrast to the spigot arrangement of the split impeller 21' shown in FIGS. 5–6, however, the present invention provides the spigot arrangement of the split impeller 21 which beneficially relocates critical contact points away from the exducer front end and the exducer blade root leading edges. It thus beneficially provides an off-loading of stress away from the front end 48 of the exducer 23, by relocating the axial plane to the downstream edge of the spigot 52, as axial contact is now provided between surfaces 60 and 62. Preferably, exducer front end stresses are further reduced by providing transitional surface 62, and by spacing transitional surface 62 sufficiently radially away from the spigot so as to relocate the circumferential spigot contact area, between the inner and outer axial surfaces 64, 58, further downstream and thus away from the front end 48 of the exducer disc body 42. Yet further, the invention preferably further reduces exducer front end stresses by providing sufficient spacing between the rear end 46 of the inducer disc body 36 and the front end 48 of the exducer disc body 42, thus preferably eliminating the potential for a contact point corresponding to point 70 on impeller 21' of FIG. 6. Still further, the preferably rounded edge 66 of the inner axial surface 64 of the split impeller 21 of FIGS. 2–4, provides a suitably blunt contact area with respect to the annular spigot 52, larger than the contact point 72 of the split impeller 21' of FIGS. 5–6, thereby improving the contact conditions and resulting in stress reduction. Therefore, the spigot arrangement of the split impeller 21 of FIGS. 2–4, advantageously reduces stresses on the exducer.

The present invention therefore provides a spigot arrangement for the split impeller which advantageously relocates critical contact points relatively downstream location to a stronger portion of the disc to off-load the front end of the exducer disc body. Thus the stresses blade root leading edge region of the exducer is thereby improved, thereby considerably reducing the localized blade root stress of the exducer and resulting in reducing potential for LCF cracks in contacting surfaces of the split impeller. Also, by providing an axial gap (between 46 and 48), the present invention has also eliminated a previously problematic contact point on the axial face of the spigot (i.e. point 70).

The above description is meant to be exemplary only, and one skilled in the art will recognize that changes may be made to the embodiments described without departure from the scope of the invention disclosed. For example, the transitional surface 62 in the split impeller 21 of FIGS. 2–4, if provided, can be made in any other profile provided it does not contact the annular spigot 52. The spacing between the arrays of the blades of the inducer and the exducer can vary to zero. Still other modifications which fall within the scope of the present invention will be apparent to those skilled in the art, in light of a review of this disclosure, and such modifications are intended to fall within the appended claims.

The invention claimed is:

1. A split impeller assembly for a gas turbine engine, the split impeller having inducer and exducer bodies matingly mounted to one another at respective rear and front faces, the split impeller assembly further comprising:

a central recess co-axially defined in the front face of the exducer body, the recess having an inwardly extending radial surface spaced apart from the front face; and an annular spigot protruding axially from of the rear face of the inducer body, the spigot being received in the recess, the spigot having a terminal radial surface spaced apart from the rear face, in order to contact the inwardly extending radial surface of the recess of the exducer body such that the rear face of the inducer body and the front face of the exducer body are spaced apart to form a gap therebetween.

2. The split impeller assembly of claim 1 wherein the recess includes a first axial portion and a second axial portion, the first front portion adjacent the front face of the exducer body and the second axial portion adjacent the inwardly extending radial surface, the first axial portion having a diameter larger than a spigot diameter such that the first axial portion does not contact the spigot, the second axial portion having a diameter sufficiently close to spigot diameter such that the second axial portion contacts the spigot.

3. The split impeller assembly of claim 2 wherein the recess includes a radiused transitional surface between the first and second axial surfaces, and wherein the radius is adapted to reduce contact stresses between the inducer and exducer bodies in a vicinity of the transitional surface.

4. The split impeller assembly of claim 3 wherein said transitional surface is spaced downstream from the front face of the exducer body.

5. The split impeller assembly as claimed in claim 3 wherein the transitional surface extends smoothly downstream to the inner axial surface, thereby forming a rounded upstream edge of the second axial portion.

6. The split impeller assembly of claim 1 wherein said gap is sized sufficiently large such that said gap is maintained during engine transient operating conditions.

7. An impeller of a gas turbine engine comprises:

an axial-flow rotor portion having a first array of blades extending outwardly from a first disc body thereof, the first disc body including an annular spigot protruding axially from a rear end thereof and being co-axial with the axial-flow rotor portion; and a centrifugal rotor portion having a second array of blades extending outwardly from a second disc body thereof, the second disc body including a recess defined in an upstream side of the second disc body for snugly accommodating the annular spigot of the first disc body, the second disc body including means for reducing localized contact stresses between the first and second disc bodies when local distortion of the disc bodies occurs during engine operation.

8. The impeller as claimed in claim 7 wherein the means for reducing localized contact stresses comprises and an inner axial surface defined in the recess for contacting an outer axial surface defined on the annular spigot of the first disc body, the inner axial surface having a rounded upstream edge thereof to provide an increased contact area with the outer axial surface when said local distortion occurs during engine operation.

9. The impeller as claimed in claim 8 wherein the rounded edge of the inner axial surface is axially spaced apart from the front end of the second disc body.

10. The impeller as claimed in claim 9 wherein the front end of the second disc body is spaced apart from the rear end of the first disc body.

11. The impeller as claimed in claim 9 wherein the annular spigot of the first disc body comprises a first radial surface at a downstream end of the outer axial surface, and wherein the recess of the second disc body comprises a second radial surface at a downstream end of the inner axial surface, the first radial surface abutting the second radial surface while the front end of the second disc body is spaced apart from the rear end of the first disc body.

12. The impeller as claimed in claim 7 wherein leading edges of the blades of the centrifugal rotor portion are axially spaced apart from trailing edges of the blades of the axial-flow rotor portion, respectively.

13. The impeller as claimed in claim 7 wherein leading edges of the blades of the centrifugal rotor portion are circumferentially spaced apart from trailing edges of the blades of the axial-flow rotor portion, respectively.

14. The impeller as claimed in claim 7 wherein leading edges of the blades of the centrifugal rotor portion extend radially, axially and upstream from the second disc body.

15. A split impeller assembly of a gas turbine engine comprising an inducer body having a downstream disc face and a first axial contact face spaced axially downstream from said downstream face, the first axial contact face disposed radially inside a peripheral portion of said downstream disc face; and an exducer body having an upstream disc face and a second axial contact face spaced axially downstream from said upstream face, the second axial contact face disposed radially inside a peripheral portion of said upstream disc face, wherein when said inducer and exducer bodies are mounted together said first and second axial contact faces contact one another and said peripheral portions of said downstream and upstream disc faces are spaced apart from one another.

* * * * *